US011686320B2

(12) United States Patent
Stanley et al.

(10) Patent No.: US 11,686,320 B2
(45) Date of Patent: Jun. 27, 2023

(54) CENTRIFUGAL FAN

(71) Applicant: The Charles Machine Works, Inc., Perry, OK (US)

(72) Inventors: Tyler J. Stanley, Edmond, OK (US); Blaine S. Talbot, Stillwater, OK (US); Matthew L. Lemmons, Perry, OK (US); Thomas Howard Mertz, Stillwater, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 17/962,709

(22) Filed: Oct. 10, 2022

(65) Prior Publication Data

US 2023/0036202 A1 Feb. 2, 2023

Related U.S. Application Data

(63) Continuation of application No. 17/226,673, filed on Apr. 9, 2021, now Pat. No. 11,480,189, which is a continuation of application No. 16/514,287, filed on Jul. 17, 2019, now Pat. No. 10,975,879.

(60) Provisional application No. 62/699,939, filed on Jul. 18, 2018.

(51) Int. Cl.
*F04D 29/28* (2006.01)
*F04D 29/42* (2006.01)

(52) U.S. Cl.
CPC ..... *F04D 29/281* (2013.01); *F04D 29/4226* (2013.01); *F05D 2250/711* (2013.01); *F05D 2250/712* (2013.01)

(58) Field of Classification Search
None
See application file for complete search history.

(56) References Cited

U.S. PATENT DOCUMENTS

| | | | |
|---|---|---|---|
| 3,144,204 | A | 8/1964 | Bohanon |
| 3,414,188 | A | 12/1968 | Gallie |
| 4,411,453 | A | 10/1983 | Phillipps et al. |
| 4,419,049 | A | 12/1983 | Gerboth et al. |
| 4,531,890 | A | 7/1985 | Stokes |
| 4,850,535 | A | 7/1989 | Ivie |
| 5,011,087 | A | 4/1991 | Richardson et al. |
| 5,343,831 | A | 9/1994 | Collins |
| 5,944,481 | A | 8/1999 | Stone et al. |
| 6,074,153 | A | 6/2000 | Allen |

(Continued)

FOREIGN PATENT DOCUMENTS

WO 2019215785 A1 11/2019

OTHER PUBLICATIONS

United States Patent and Trademark Office, "Office Action Summary", dated Jan. 8, 2018, 10 pages, Alexandria, VA.

*Primary Examiner* — Michael Lebentritt
(74) *Attorney, Agent, or Firm* — Tomlinson McKinstry, P.C.

(57) ABSTRACT

A centrifugal fan is formed from an impeller installed within a casing. The impeller is formed from two plates that are interconnected by a plurality of blades. A duct extends through each blade. At each of its ends, the duct opens at one of the plates. Air enters the fan from through a central opening formed in one of the plates, moves to a medial zone between the plates, and exits the fan at the medial zone's unwalled periphery. Air also crosses the fan by way of the ducts formed within each blade.

20 Claims, 20 Drawing Sheets

(56) References Cited

U.S. PATENT DOCUMENTS

| | | | | |
|---|---|---|---|---|
| 8,007,240 | B2 | 8/2011 | Sanagi et al. | |
| 8,071,037 | B2 | 12/2011 | Harinath et al. | |
| 9,039,362 | B2 | 5/2015 | Fukuda | |
| 10,100,579 | B2 | 10/2018 | Campbell et al. | |
| 10,975,879 | B2 * | 4/2021 | Stanley | F04D 29/4226 |
| 11,480,189 | B2 * | 10/2022 | Stanley | F04D 29/4226 |
| 2009/0123285 | A1 | 5/2009 | Sinzaki | |
| 2010/0115983 | A1 | 5/2010 | Ikeda et al. | |
| 2010/0322762 | A1 | 12/2010 | Shirahama et al. | |
| 2011/0247308 | A1 | 10/2011 | Davis et al. | |
| 2012/0045323 | A1 | 2/2012 | Kagawa et al. | |
| 2014/0260190 | A1 | 9/2014 | DeGeorge | |
| 2015/0086348 | A1 | 3/2015 | Uehara et al. | |
| 2015/0176451 | A1 | 6/2015 | Tsutsumi | |
| 2017/0016453 | A1 | 1/2017 | Knopp | |
| 2019/0010961 | A1 | 1/2019 | Kumaou | |
| 2019/0195235 | A1 | 6/2019 | Ida et al. | |
| 2019/0277309 | A1 | 9/2019 | Horii | |
| 2020/0116157 | A1 | 4/2020 | Tanaka et al. | |
| 2021/0008310 | A1 | 1/2021 | Wada et al. | |

* cited by examiner

CENTRIFUGAL FAN

SUMMARY

The present invention is directed to an impeller having a rotational axis. The impeller may be installed within a casing to form a centrifugal fan. The impeller comprises a first plate having a central opening and a plurality of duct openings, and a second plate having a central hub and a plurality of duct openings. The impeller further comprises a plurality of blades interconnecting the first and second plates and circumferentially spaced around the rotation axis. Each blade comprises an open-ended duct formed within the blade and interconnecting one and only one duct opening in the first plate with one and only one duct opening in the second plate.

DETAILED DESCRIPTION

With reference to FIGS. 1-5, an impeller 10 is shown. The impeller 10 may be installed within a casing 12 in order to function as a centrifugal fan 14, as shown in FIGS. 8-12. The centrifugal fan 14 may be incorporated into any number of devices to provide cooling, such as stationary machines or motor vehicles. FIGS. 13-16, for example, show how the fan 14 may be incorporated into a work machine 16.

Figure 1:
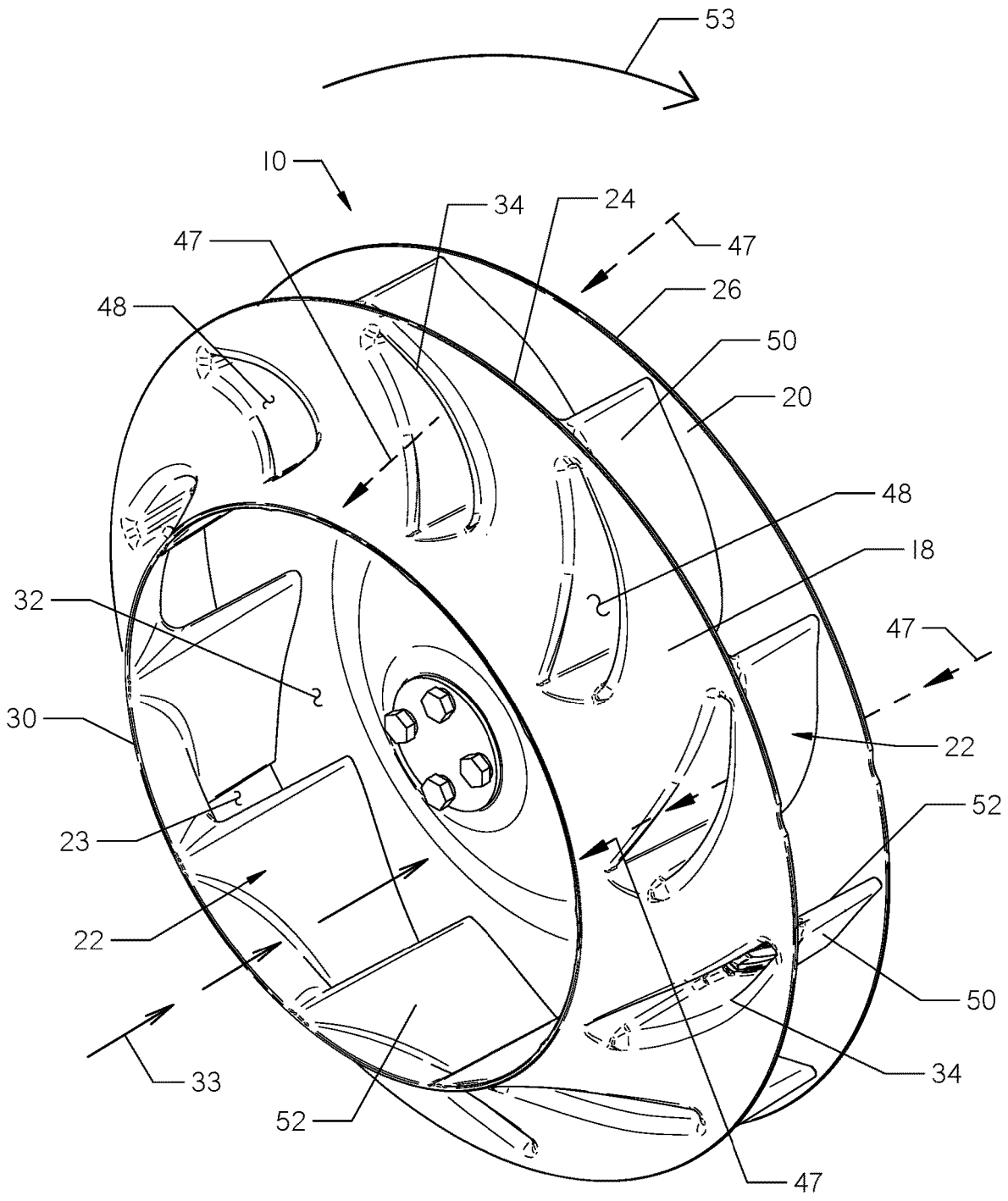
FIG. 1 is a front perspective view of an impeller.
Figure 2:
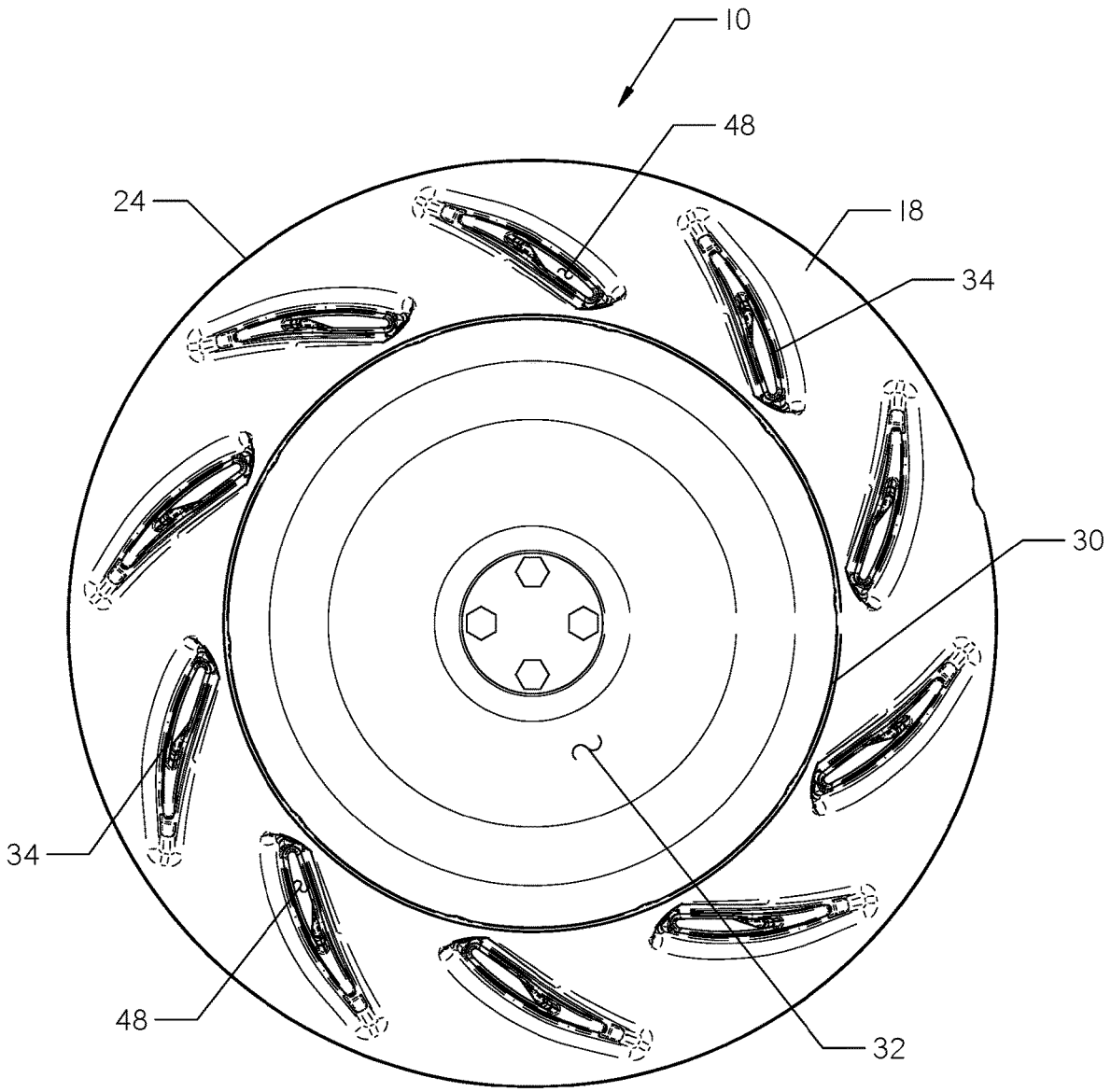
FIG. 2 is a front elevation view of the impeller shown in FIG. 1.
Figure 3:
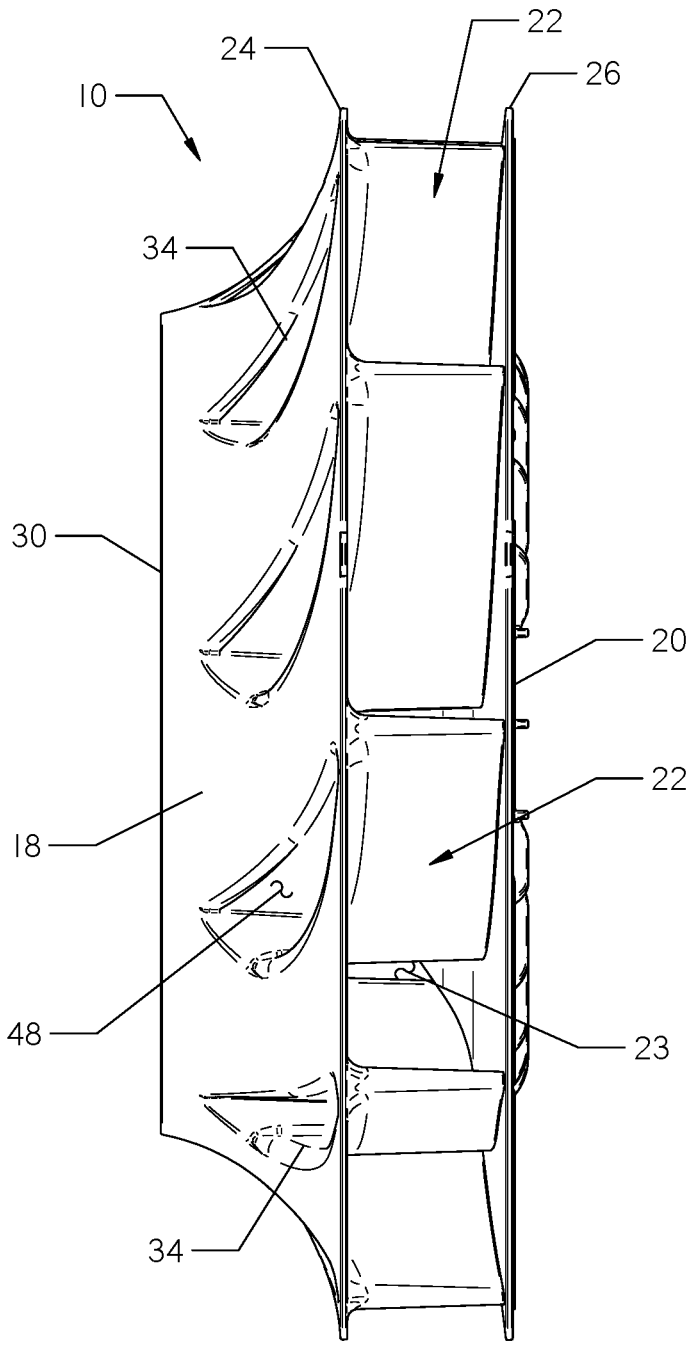
FIG. 3 is a side elevation view of the impeller shown in FIG. 1.
Figure 4:
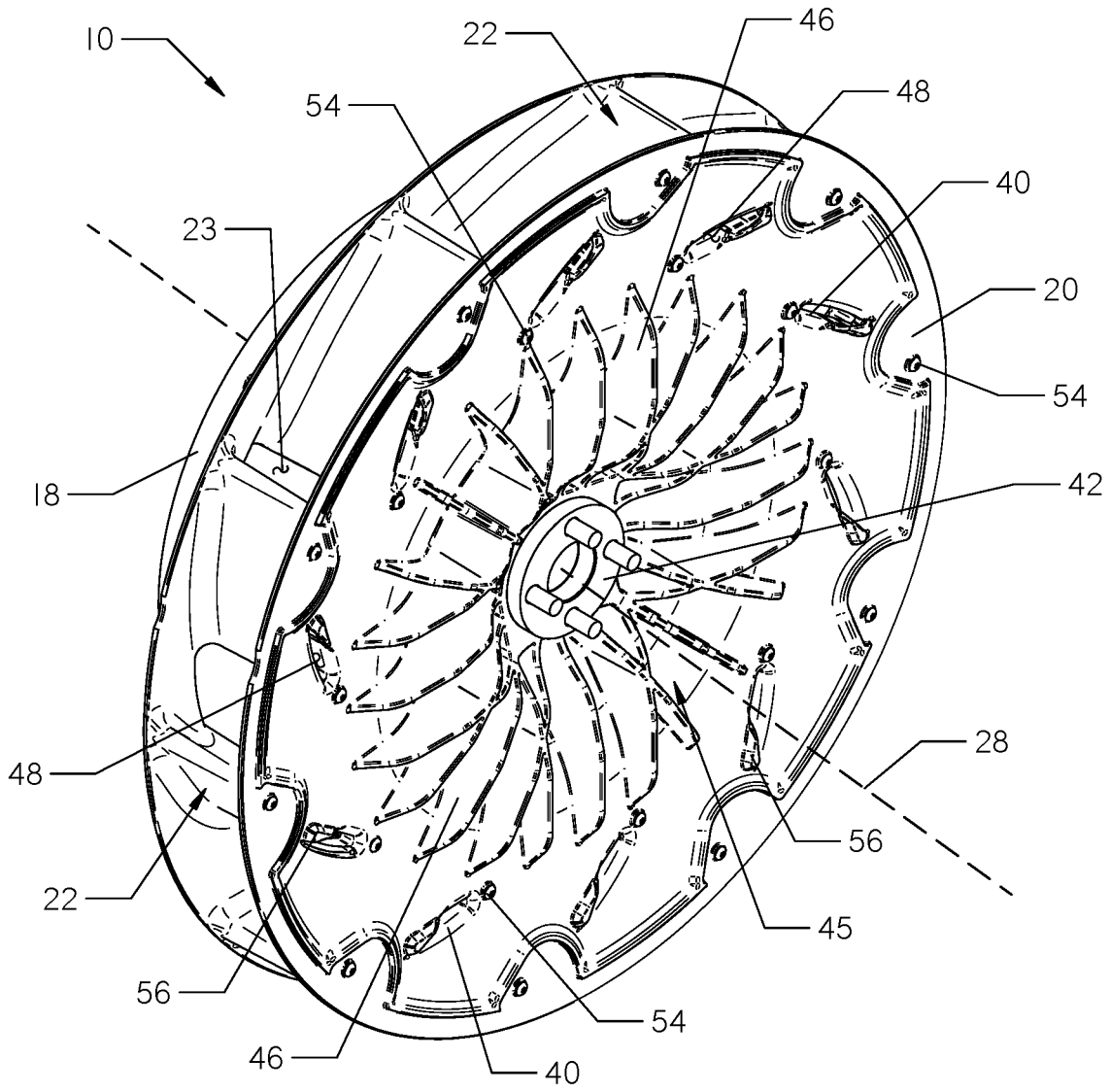
FIG. 4 is a rear perspective view of the impeller shown in FIG. 1.

Continuing with FIGS. 1-5, the impeller 10 has a generally cylindrical shape and is preferably made of plastic or aluminum. The impeller 10 comprises a first plate 18 interconnected with a second plate 20 by a plurality of blades 22, as shown in FIGS. 1, 3, and 4. The first and second plates 18 and 20 are coaxially disposed, and have identical axial footprints, as shown in FIGS. 1 and 3. The outer peripheries 24 and 26 of each plate 18 and 20 have a circular shape. In operation, the impeller 10 is configured to rotate about a rotational axis 28, shown in FIGS. 4 and 11. The blades 22 are circumferentially spaced about the rotational axis 28. The blades 22 are positioned so that an opening 23 is formed between each blade 22, as shown by FIGS. 1, 3 and 4.

With reference to FIGS. 1-3, the first plate 18 comprises a funnel-shaped structure that tapers toward the second plate 20. A central opening 30 is formed in the first plate 18 that opens into a medial zone 32. The medial zone 32 is the space formed between the plates 18 and 20. The zone 32 is at least partially surrounded by the plurality of blades 22. However, because an opening 23 is formed between each blade 22, the zone 32 has no peripheral wall. The central opening 30 and the medial zone 32 form a first fluid path segment 33, as shown in FIG. 1. A plurality of duct openings 34 are formed on the external surface of the first plate 18 and are circumferentially spaced around the central opening 30.

Figure 5:
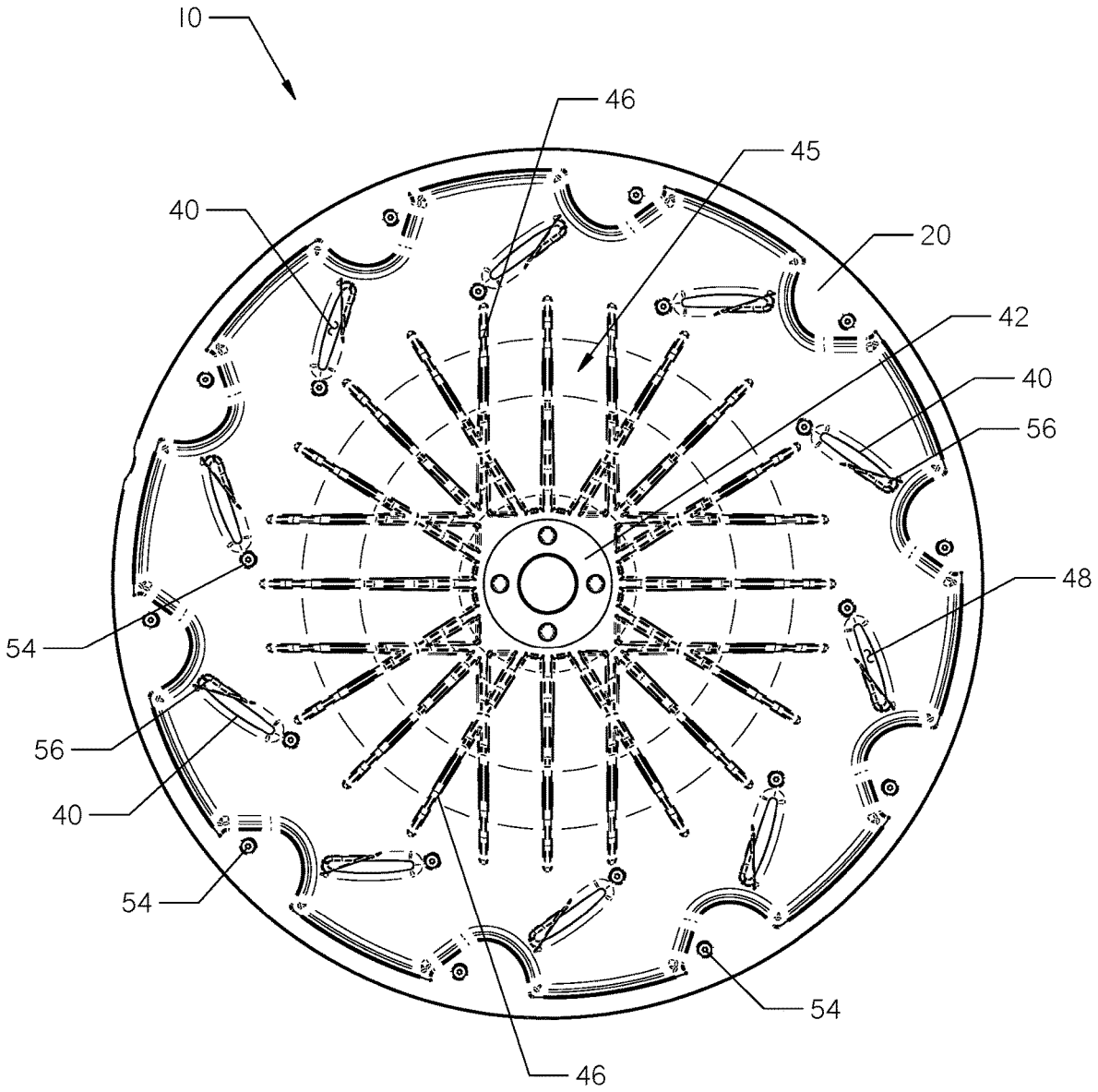
FIG. 5 is a rear elevation view of the impeller shown in FIG. 1.
Figure 11:
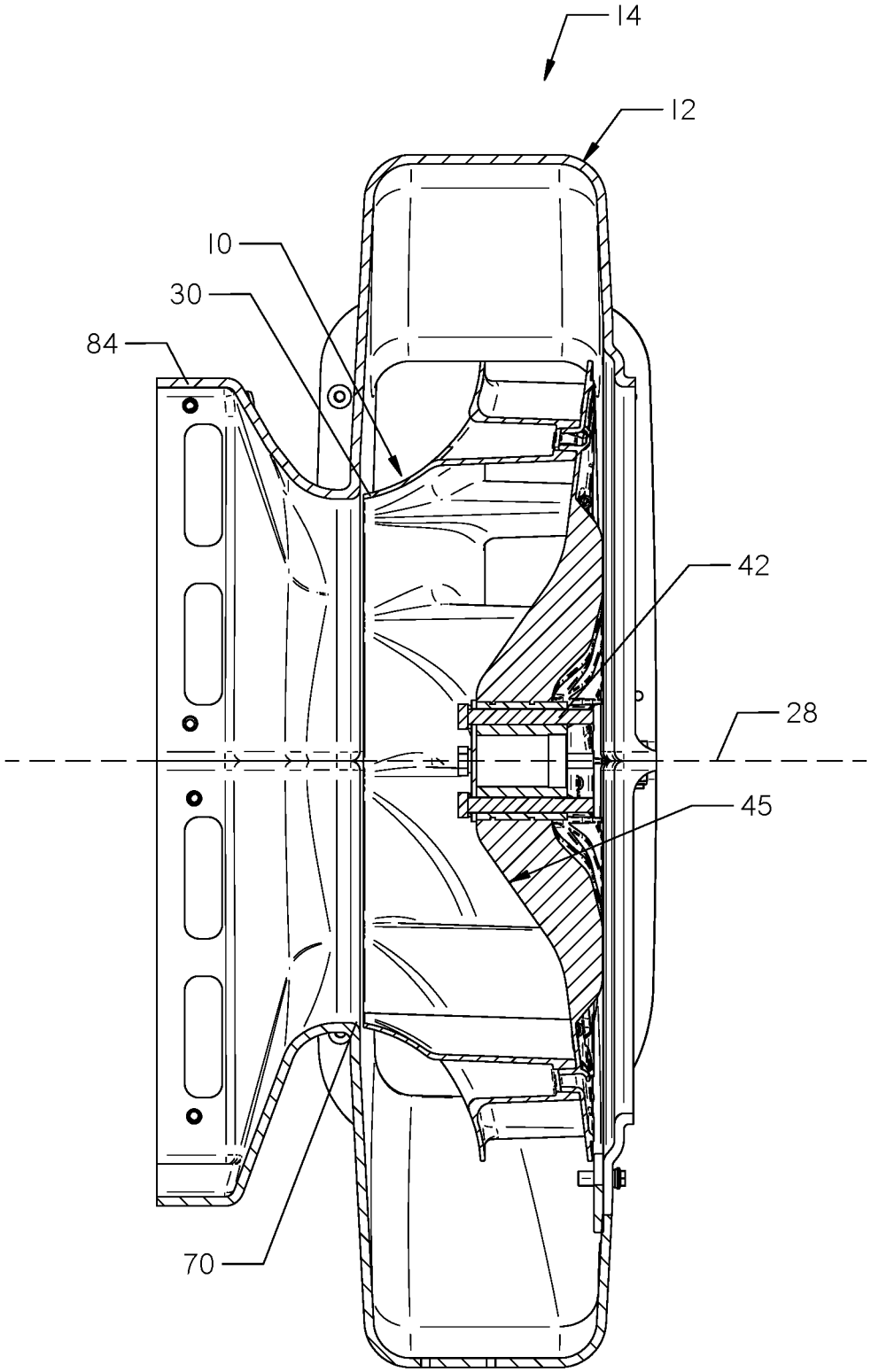
FIG. 11 is a cross-sectional view of the centrifugal fan shown in FIG. 10. The fan is sectioned by a plane that extends through the axis A-A shown in FIG. 10.

With reference to FIGS. 4 and 5, the second plate 20 is substantially imperforate, with the exception of a plurality of duct openings 40 and a central connection point 42. The duct openings 40 are aligned with the duct openings 34 formed in the first plate 18. The connection point 42 is preferably made of aluminum and is supported by a hub 45 formed in the center of the second plate 20. The hub 45 tapers towards the connection point 42, as shown in FIG. 11.

A plurality of interconnected splines 46 are formed on the hub 45 and extend radially from the connection point 42. The splines 46 are integral with and made of the same material as the second plate 20. Each of the splines 46 has a wing-like shape, as shown in FIG. 11. The splines 46 provide stability and support to the impeller 10. In alternative embodiments, the splines may each be separate pieces that are attached to the hub.

Figure 15:
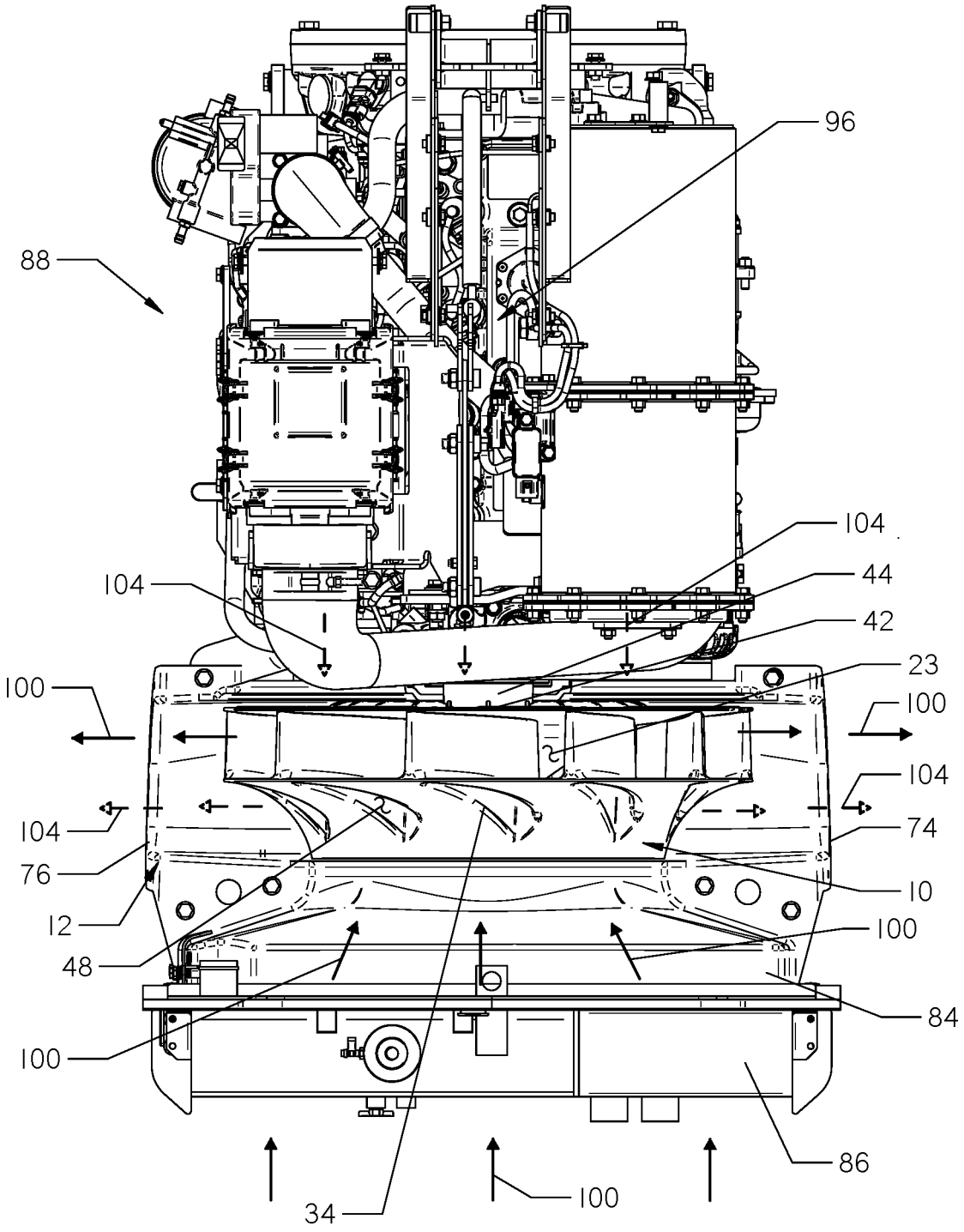
FIG. 15 is the top plan view of the engine compartment shown in FIG. 14. The exhaust pipe has been removed and a portion of the casing of the centrifugal fan has been cut away to expose the impeller.

The second plate 20 can be joined to a rotary shaft at the connection point 42. One such rotary shaft 44 is shown in FIG. 15. When joined to a rotary shaft, the second plate 20 is rotatable about the rotational axis 28, shown in FIGS. 4 and 11.

Continuing with FIGS. 1-5, an open-ended duct 48 is formed within each of the blades 22. Each duct 48 is a hollow passageway that interconnects one and only one duct opening 34 in the first plate 18 with one and only one duct opening 40 in the second plate 20. Fluid can flow through the impeller 10 by way of the ducts 48, without traversing any part of the first fluid path segment 33. Thus, each of the ducts 48 forms one or more second fluid path segments 47, as shown in FIG. 1. The first fluid path segment 33 and the one or more second fluid path segments 47 are mutually exclusive. However, because the segments 33 and 47 are adjacent one another, heat may be exchanged between fluids flowing on the respective paths.

Continuing with FIG. 2, the blades 22 extend at a non-zero angle between the central opening 30 and the outer periphery 24 of the first plate 18. For example, if the central opening 30 is considered a circle, each of the blades 22 may extend between a 15 and 50 degree angle relative to a tangent of the circle.

Each of the blades 22 has a concave first external surface 50 and an opposed convex second external surface 52, as shown in FIG. 1. In operation, the impeller 10 rotates in the direction of arrow 53, shown in FIG. 1. The concave first external surface 50 of each of the blades 22 leads as the impeller 10 rotates. The plurality of blades 22 produce a fluid current as the impeller 10 rotates. The fluid making up the fluid current is typically a gas, such as air.

The blades 22 shown in the Figures are "backward-curved", meaning that they curve against the direction of rotation of the impeller 10. Put differently, the concave surface 50 of the blade 22 faces away from the direction of rotation 53. In alternative embodiments, not shown in the Figures, the impeller may be formed with "forward-curved" blades.

The blades 22 and the first plate 18 are formed as a single piece, as shown in FIGS. 1 and 3. The second plate 20 is secured to each of the blades 22 by a plurality of fasteners 54, as shown in FIGS. 4 and 5. In alternative embodiments, the first plate, blades, and second plate may be formed as a single piece. In further alternative embodiments, the first plate, blades, and second plate may each be separate pieces.

Figure 6:
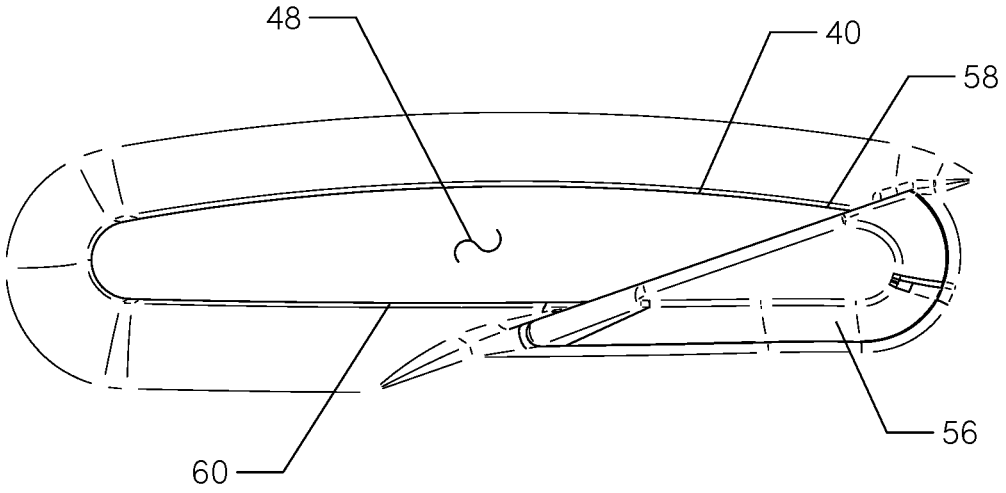
FIG. 6 is an enlarged front elevation view of one of the plurality of duct openings shown in FIGS. 4 and 5.
Figure 7:
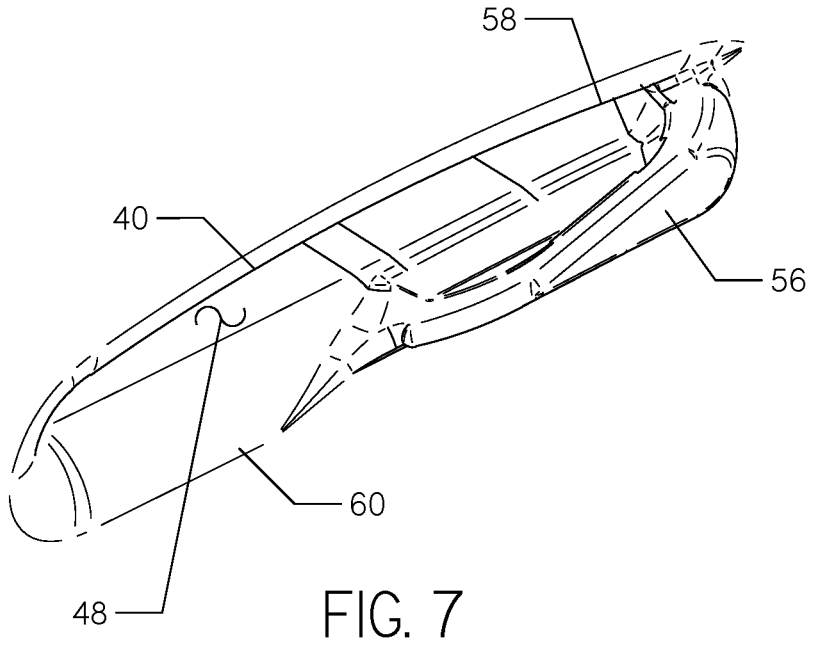
FIG. 7 is a perspective view of the duct opening shown in FIG. 6.

With reference to FIGS. 4-7, a ledge 56 projects from each of the duct openings 40 on the second plate 20. The ledge 56 at least partially overlaps a portion of each duct opening 40, as shown in FIGS. 6 and 7. The ledge 56 extends at a non-zero angle between a top edge 58 of the duct opening 40 to the middle of a bottom edge 60 of the duct opening 40. For example, the ledge 56 shown in the Figures extends at about a 45 degree angle between the top and bottom edge 58 and 60. In operation, the ledge 56 helps direct fluid into the duct 48. In alternative embodiments, the ledge may have different shapes or sizes than those shown in the figures.

Figure 8:
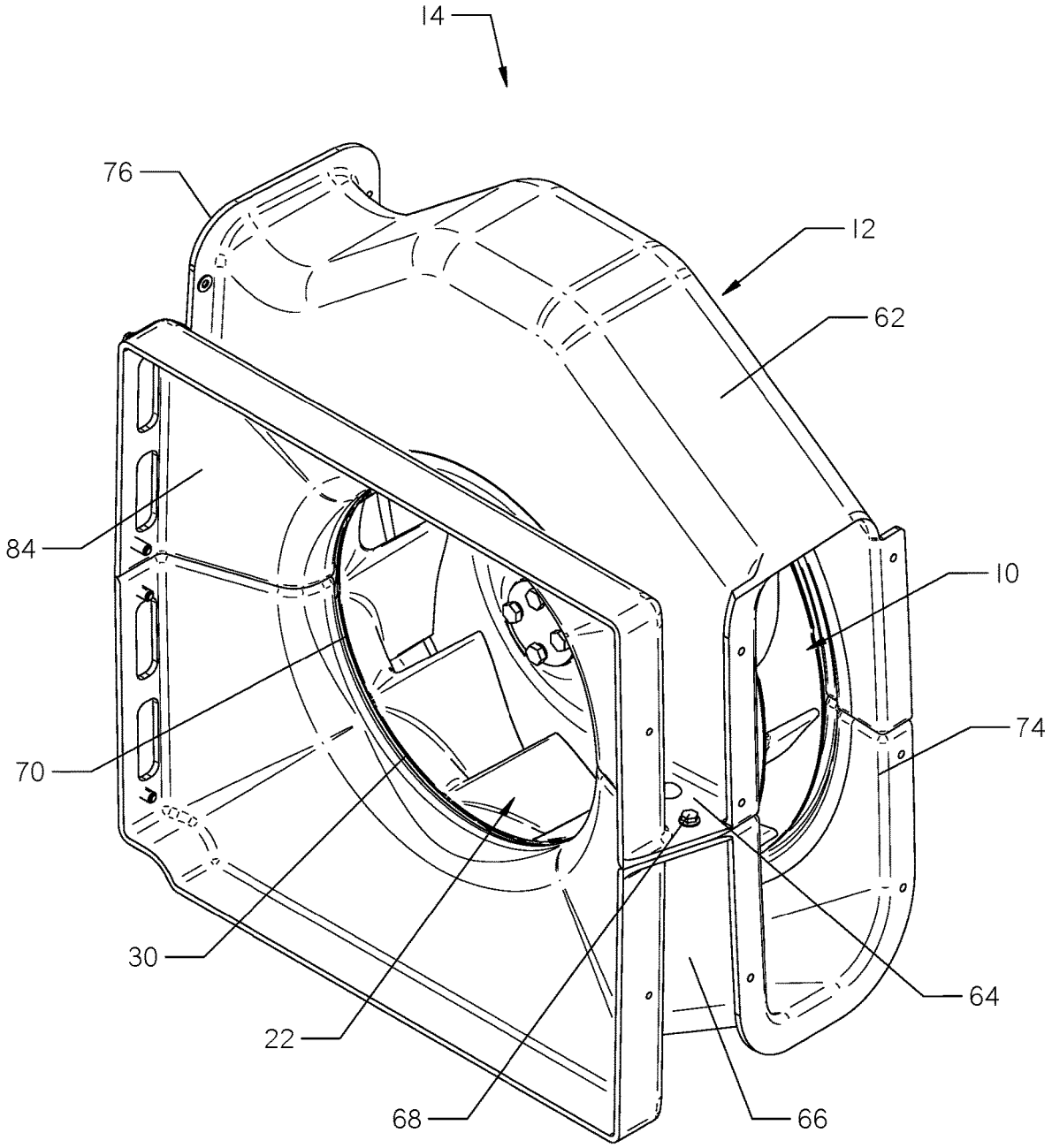
FIG. 8 is a front perspective view of a centrifugal fan that includes the impeller shown in FIG. 1.
Figure 9:
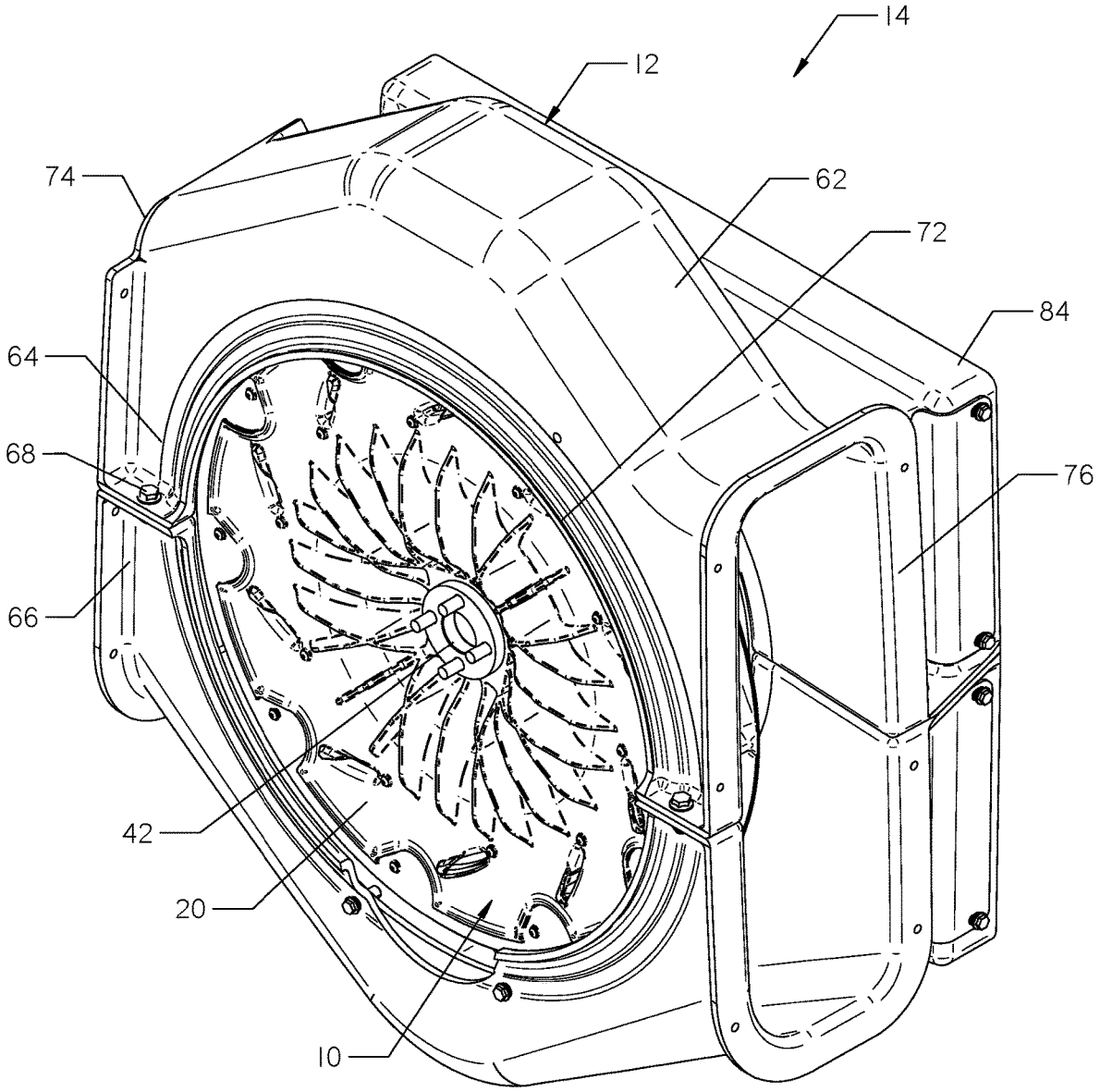
FIG. 9 is a rear perspective view of the centrifugal fan shown in FIG. 8.
Figure 10:
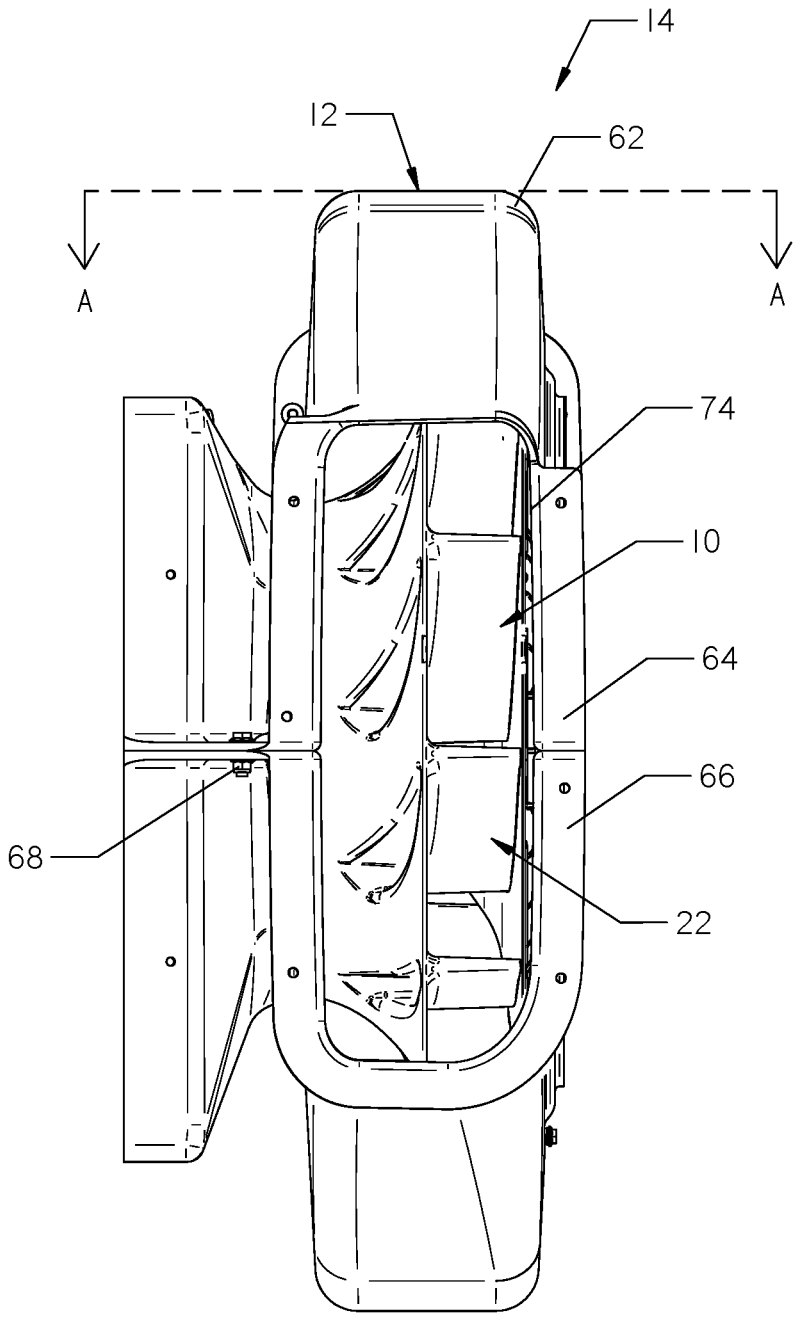
FIG. 10 is a side elevation view of the centrifugal fan shown in FIG. 8.

Turning to FIGS. 8-12, the impeller 10 is installed within the casing 12 to form the centrifugal fan 14. The casing 12 is preferably made of fiberglass and comprises a generally cylindrical body 62 sized to house the impeller 10. The casing 12 may also be made of plastic. The casing 12 is formed from a top piece 64 and a bottom piece 66 which are secured together by a plurality of fasteners 68, as shown in FIGS. 8-10. The impeller 10 is positioned intermediate within the pieces 64 and 66 prior to assembling the casing 12.

A first opening 70 and a second opening 72 are formed on opposite sides of the casing 12, as shown in FIGS. 8 and 9. The first opening 70 is coaxial with the central opening 30 of the first plate 18, as shown in FIG. 8. The second opening 72 exposes the second plate 20 of the impeller 10, as shown in FIG. 9.

The impeller 10 is held in position within the casing 12 by a rotary shaft 44 attached to the connection point 42, shown for example in FIG. 15. When supported by the rotary shaft 44 within the casing 12, the impeller 10 may rotate relative to the casing 12.

Figure 12:
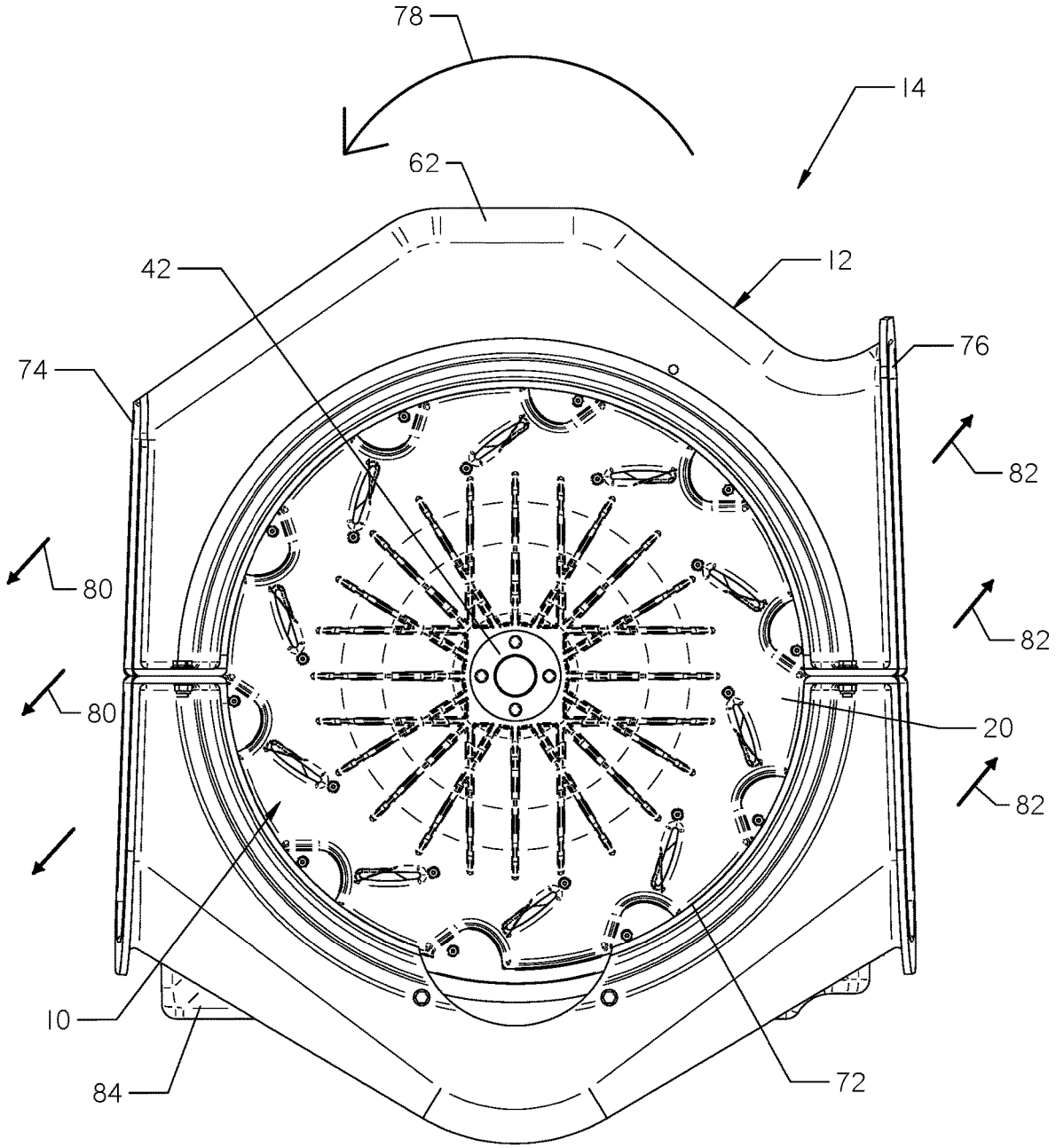
FIG. 12 is a rear elevation view of the centrifugal fan shown in FIG. 8.

A first vent 74 and a second vent 76 are formed on opposite sides of the body 62. Each vent 74 and 76 has a rectangular shape. As the impeller 10 rotates, fluid is expelled through the vents 74 and 76, as shown in FIG. 12. The impeller 10 rotates in the direction of arrow 78, shown in FIG. 12. When rotating in such direction, fluid expelled from the first vent 74 flows in a downward direction, as shown by arrows 80. In contrast, fluid expelled from the second vent 76 flows in an upwards direction, as shown by arrows 82.

Continuing with FIGS. 8-12, the casing 12 further includes an adapter 84. The adapter 84 has a generally rectangular shape and is configured to be coupled to a radiator 86, shown for example in FIGS. 14-16. The adapter 84 is formed as an extension of the first opening 70 of the casing 12, as shown in FIG. 11. The adapter 84 tapers outwardly from the boundary of the first opening 70 until it forms the generally rectangular shape shown in FIG. 8. In alternative embodiments, the adapter may be a separate piece that is attached to the casing.

In further alternative embodiments, a flexible membrane having a central opening may be positioned between the outer periphery of the adapter and the outer periphery of the radiator. The membrane may be made of rubber or other flexible material. The membrane functions as a shock absorber between the fan and the radiator. Any vibrations from rotation of the impeller are absorbed by the membrane and not transmitted to the radiator.

Figure 13:
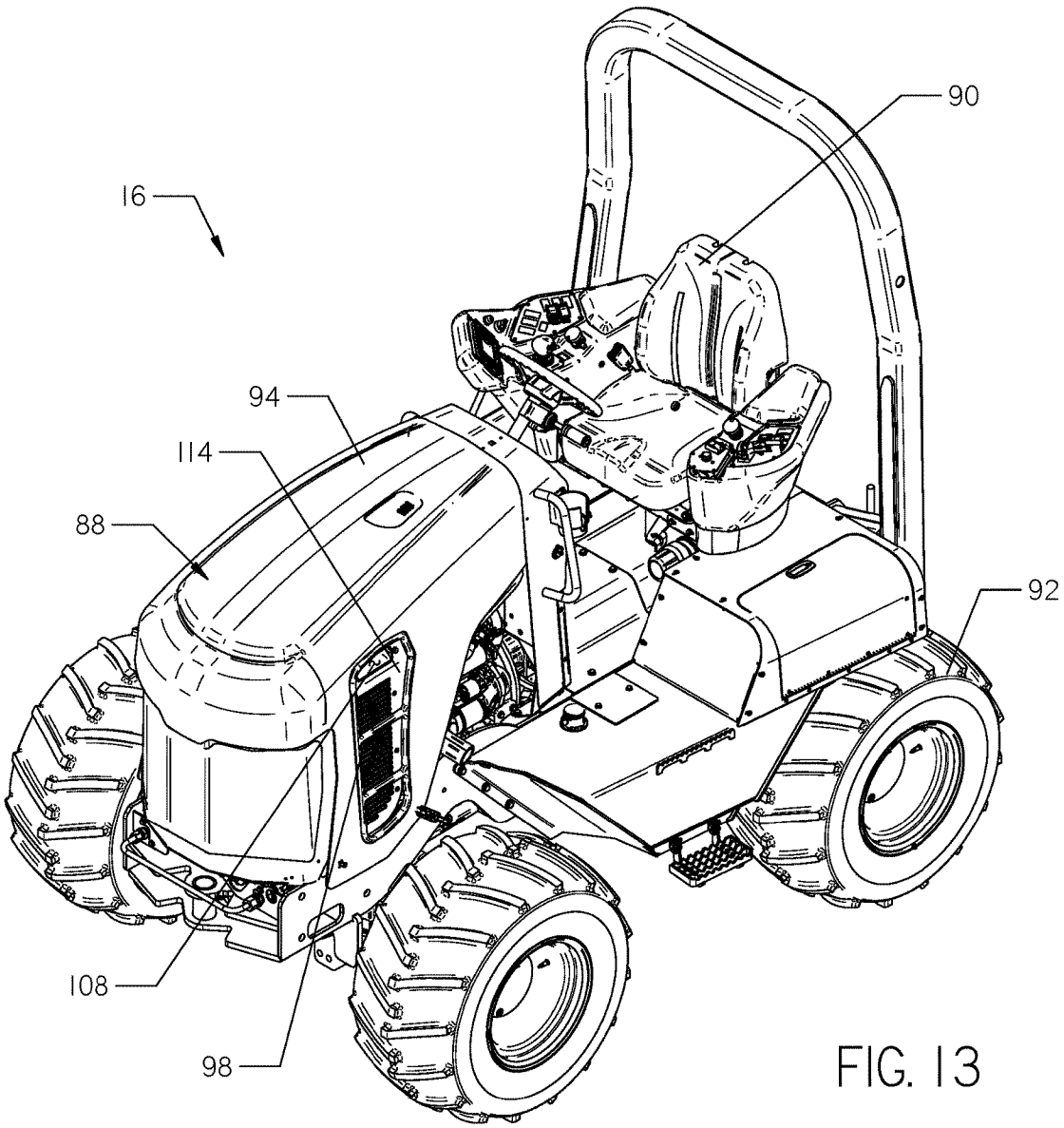
FIG. 13 is a right side perspective view of a work machine. The centrifugal fan shown in FIG. 8 is installed within an engine compartment of the work machine.
Figure 14:
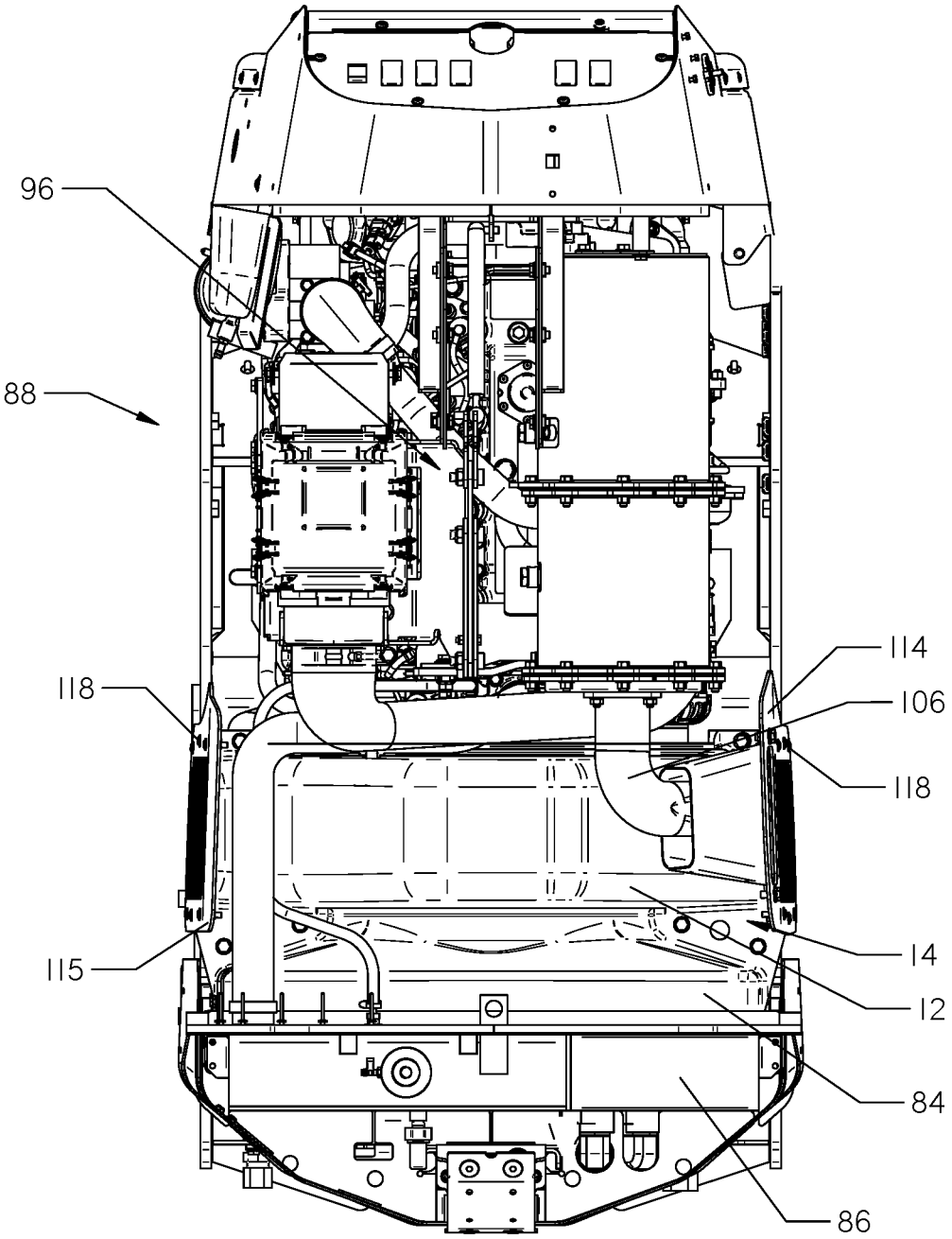
FIG. 14 is a top plan view of the engine compartment of the work machine shown in FIG. 13. The engine compartment cover has been removed.
Figure 16:
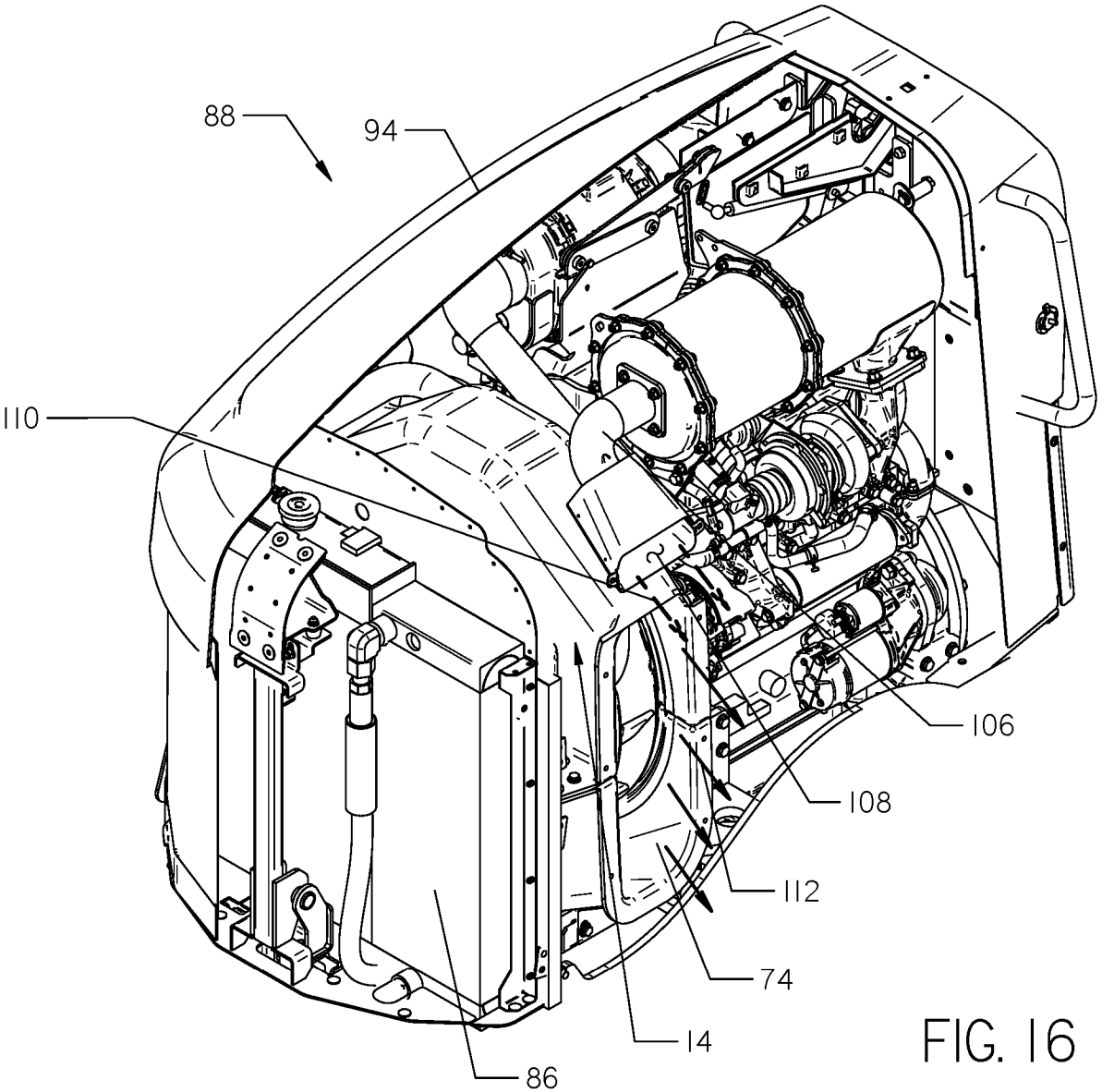
FIG. 16 is a right side perspective view of the engine compartment of the work machine shown in FIG. 13. A portion of the engine compartment cover has been cut away.

Turning to FIGS. 13-16, the centrifugal fan 14 is shown installed within a work machine 16. The work machine 16 comprises an engine compartment 88 and operator station 90 supported on a plurality of motive elements 92. The radiator 86 and an engine 96 are housed within the engine compartment 88. The fan 14 is installed within the engine compartment 88 such that it is positioned between the engine 96 and radiator 86, as shown in FIGS. 14-16. Once the fan 14 is so installed, the rotary shaft 44 is attached to the connection point 42, as shown by FIG. 15. The engine 96 powers rotation of the rotary shaft 44 which in turn rotates the impeller 10 within the casing 12. The engine compartment 88 is enclosed by a cover 94, as shown in FIG. 13. An opening 98 may be formed in each of the two opposed sides of the cover 94. Each opening 98 registers with a corresponding one of the vents 74 and 76.

With reference to FIG. 15, fluid surrounding the radiator 86 moves from around the radiator 86 to outside of the work machine 16 by flowing along a first fluid path 100. The first fluid path 100 includes the first fluid path segment 33, shown in FIG. 1. Fluid surrounding the radiator 86 flows along the first fluid path 100 and into the medial zone 32 of the impeller 10. As the impeller 10 rotates, the blades 22 create a fluid flow from the medial zone 32 into the casing 12. The fluid is carried from the medial zone 32 through the openings 23 formed between each of the blades 22. Once in the casing 12, the fluid flows through each of the vents 74 and 76 and outside of the work machine 16.

Continuing with FIG. 15, fluid surrounding the engine 96 moves from around the engine 96 to outside of the work machine 16 by flowing along a second fluid path 104. The second fluid path 104 includes the one or more second fluid path segments 47, as shown in FIG. 1. Fluid surrounding the engine 96 flows along the second fluid path 104 by first entering the duct openings 40 on the second plate 20. The fluid passes through the ducts 48 and exits the duct openings 34 on the first plate 18. After exiting the ducts 48, the fluid mixes with fluid flowing along the first fluid path 100 and is carried out of the vents 74 and 76. Thus, the paths 100 and 104 partially coincide.

Providing two fluid paths 100 and 104 allows fluid, such as hot air, surrounding both the radiator 86 and the engine 96 to be expelled by the fan 14. The dual fluid paths 100 and 104 also function to pull cool outside fluid into the work machine 16 so that the cool fluid surrounds the radiator 86 and engine 96. Thus, the fan 14 helps cool the work machine 16, or other apparatuses the fan is installed within, during operation.

With reference to FIGS. 14 and 16, the engine compartment 88 also houses an exhaust pipe 106. Work machines known in the art typically include exhaust pipes that project vertically away from the engine. Such positioning allows the hot exhaust fluid to be expelled away from the vicinity of nearby objects or persons. However, vertical exhaust pipes may obstruct an operator's view. The exhaust pipe 106 shown in FIGS. 14 and 16 extends horizontally within the engine compartment 88 and away from an operator's field of view. Such positioning causes the pipe 106 to exhaust fluid from a side of the work machine 16.

Continuing with FIG. 16, an opening 108 of the exhaust pipe 106 is positioned directly above the first vent 74 and discharges towards the ground surface. The opening 98 formed in the cover 94 may be large enough to expose the exhaust opening 108, as shown in FIG. 13. Hot exhaust is expelled downwards from the exhaust pipe 106, as shown by arrows 110. The hot exhaust mixes with fluid expelled downward from the first vent 74, as shown by arrows 112.

In operation, fluid expelled from the first vent 74 is cooler than exhaust discharged from the exhaust pipe 106. The warm fluid expelled from the first vent 74 mixes with the hot fluid exhausted from the exhaust pipe 106. As the fluids mix together, the warm fluid cools the hot fluid to an acceptable temperature for any person or object within vicinity of the work machine 16 during operation. In alternative embodiments, the exhaust pipe may be configured so that it is positioned directly above the second vent 76.

A vent cover 114 and 115 may be installed over each of the vents 74 and 76 to protect the impeller 10 during operation, as shown in FIG. 13. The covers 114 may each be attached to the casing 12 via a plurality of fasteners 118. The vent cover 114 may extend above the vent 74 and secure the exhaust pipe 106 in place, as shown in FIG. 13.

The side venting exhaust system shown in FIG. 16 may also be incorporated into any number of stationary machines or motor vehicles. The side venting exhaust may also be used with other centrifugal fans known in the art.

Figure 17:
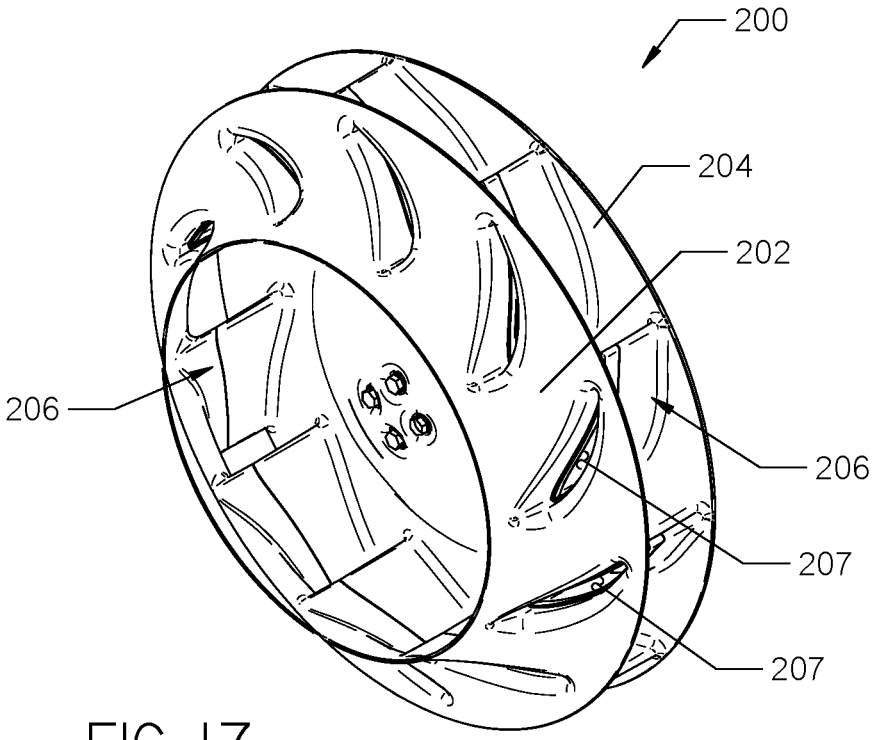
FIG. 17 is a front perspective view of another embodiment of an impeller.
Figure 18:
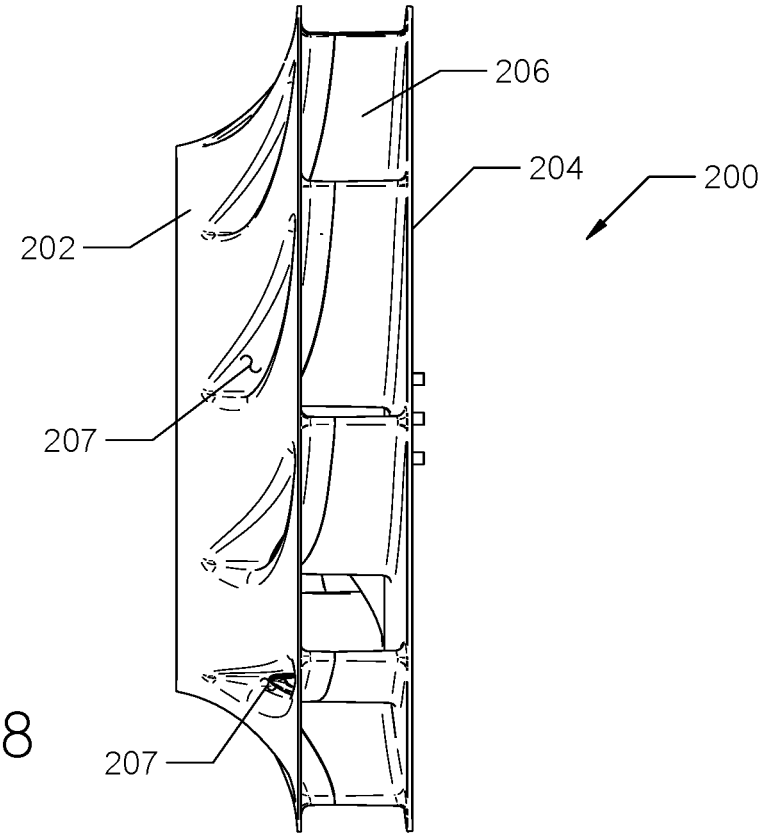
FIG. 18 is a side elevation view of the impeller shown in FIG. 17.
Figure 19:
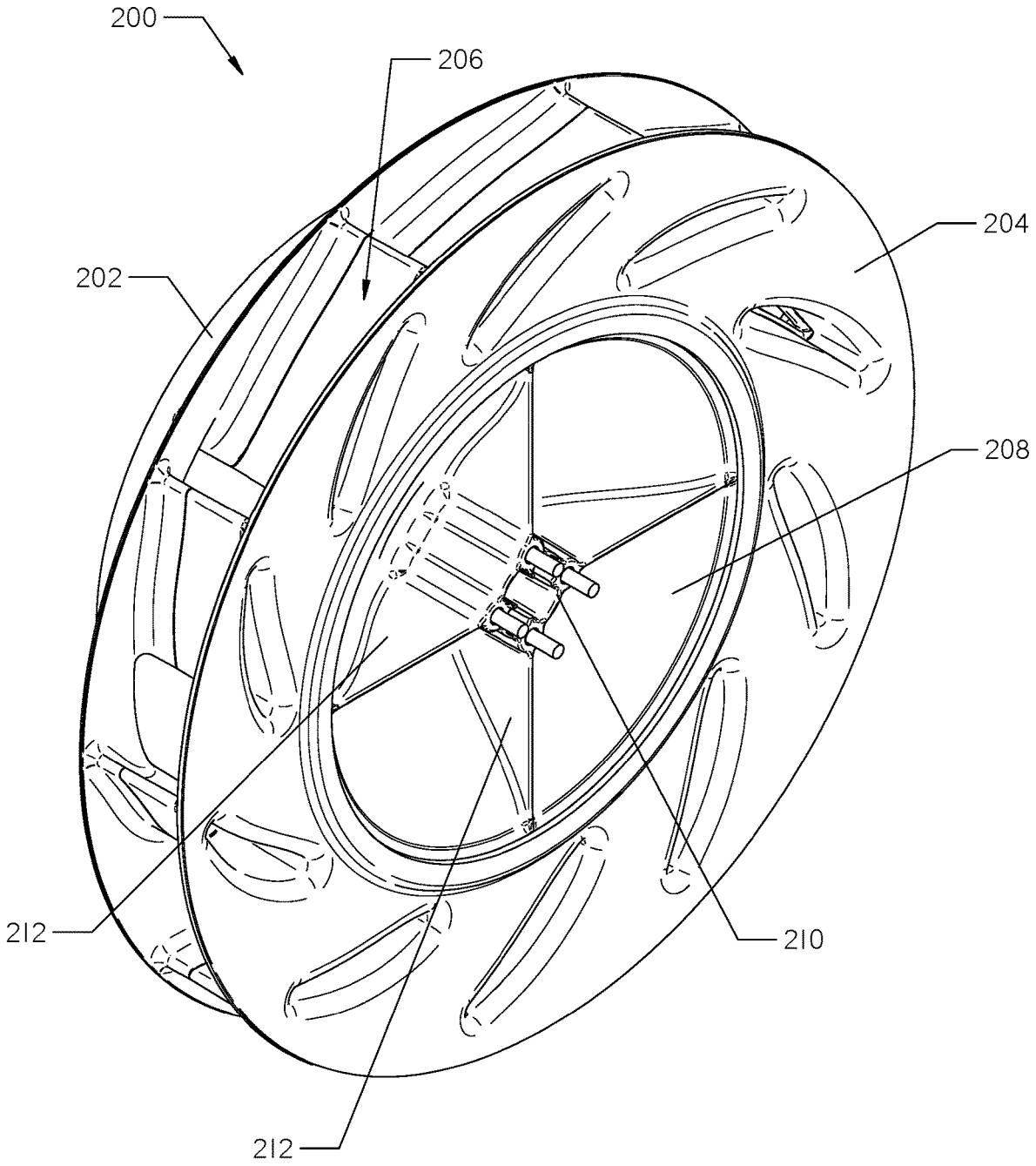
FIG. 19 is a rear perspective view of the impeller shown in FIG. 17.

Turning now to FIG. 17-19, an alternative embodiment of an impeller 200 is shown. The impeller 200 comprises a first plate 202 interconnected with a second plate 204 by a plurality of blades 206. A duct 207 is formed within each of the blades 206.

The impeller 200 is identical to the impeller 10 with a few exceptions. First, the first plate 202, second plate 204, and blades 206 are formed as a single piece. Second, a hub 208 supported by the second plate 204 is a separate piece from the second plate 204, as shown in FIG. 19. The hub 208 includes a connection point 210 and may be welded into an opening formed in the second plate 204. Unlike the hub 45, the hub 208 is supported by a plurality of braces 212, rather than a plurality of interconnected support splines. Finally, the impeller 200 does not have a ledge projecting from the opening of each duct 207 on the second plate 204. The impeller 200 may be installed within the casing 12. When installed, the impeller 200 functions identically to the impeller 10.

Figure 20:
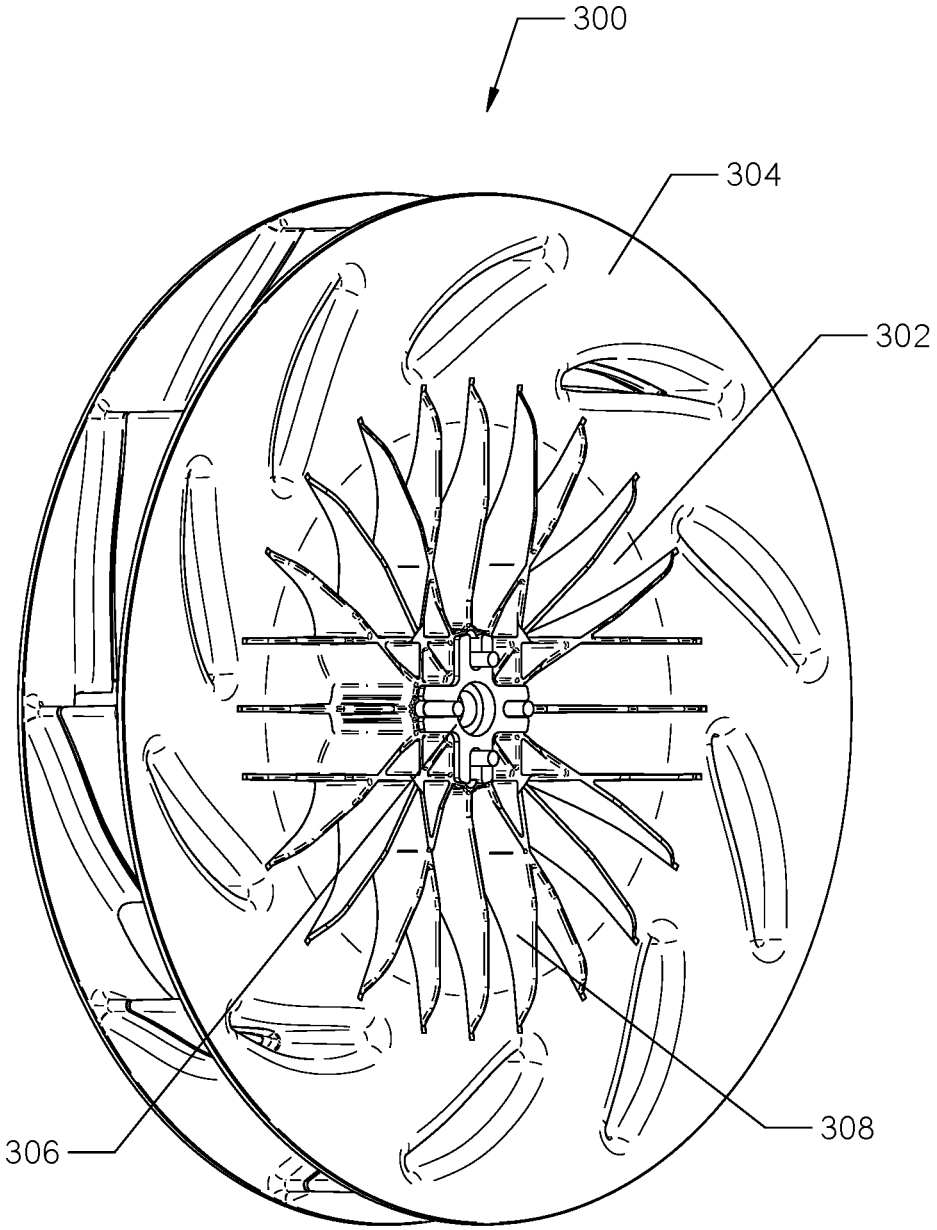
FIG. 20 is a rear perspective view of another embodiment of an impeller.

Turning now to FIG. 20, a second alternative embodiment of an impeller 300 is shown. The impeller 300 is identical to the impeller 200 with the exception of its hub 302. The hub 302 is included as part of a second plate 304, rather than being a separate piece. Similar to the hub 45 shown in FIG. 4, the hub 302 includes a connection point 306 and a plurality of interconnected support splines 308. The impeller 300 may be installed within the casing 12. When installed, the impeller 300 functions identically to the impeller 10.

Figure 21:
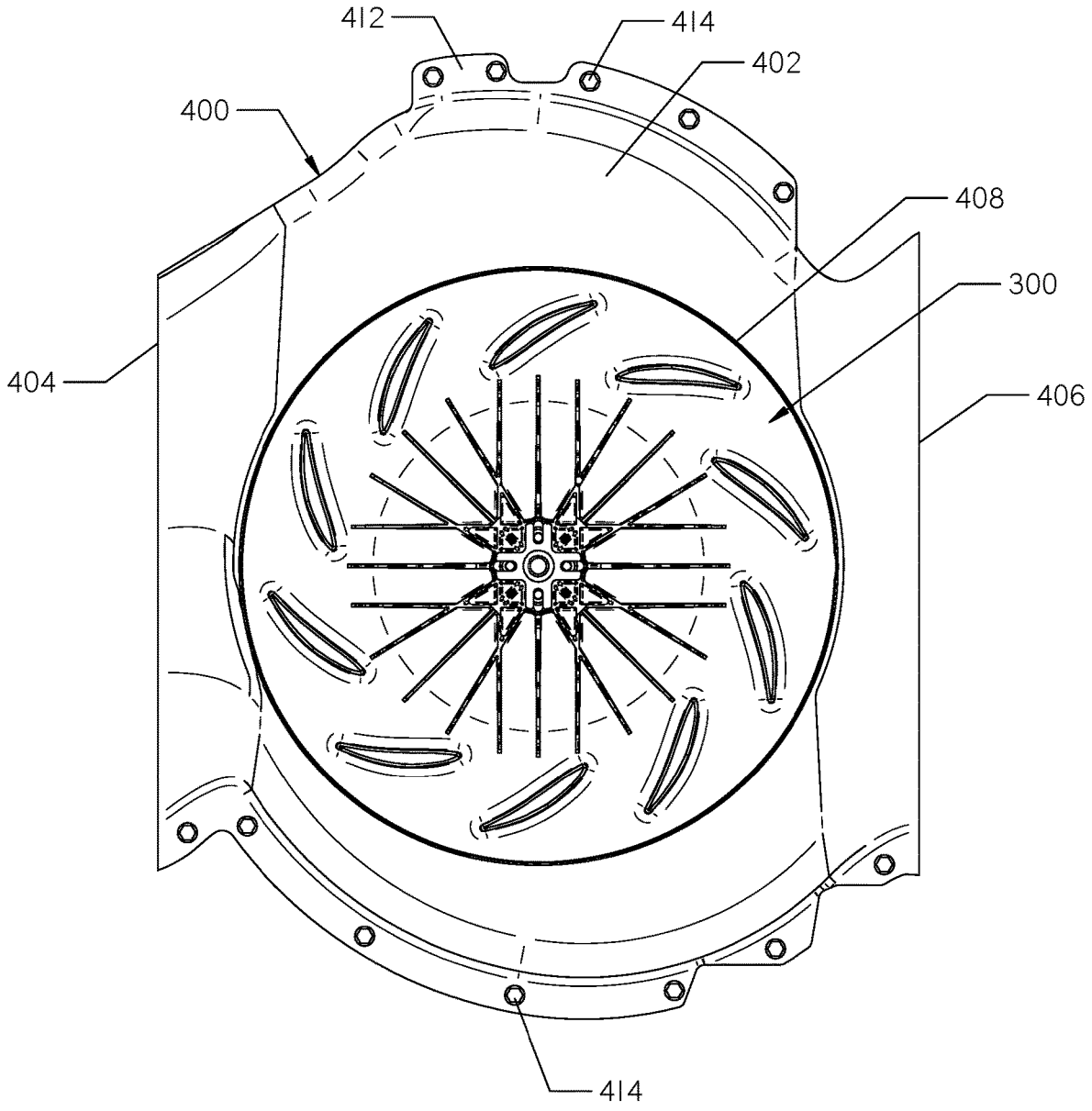
FIG. 21 is a rear elevation view of another embodiment of a casing. The impeller shown in FIG. 20 is installed within the casing.
Figure 22:
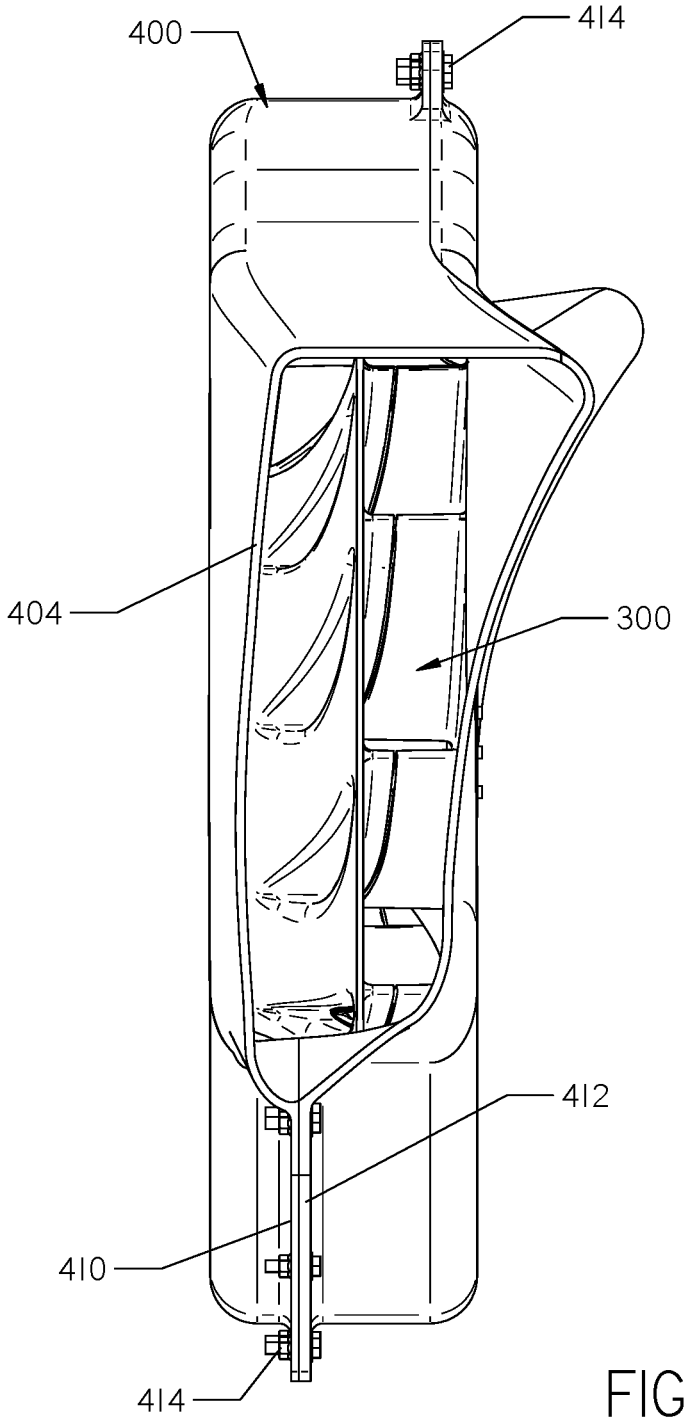
FIG. 22 is a side elevation view of the casing and impeller shown in FIG. 21.

Turning now to FIGS. 21 and 22, an alternative embodiment of a casing 400 is shown. The impeller 300 is shown installed within the casing 400. The casing 400 comprises a body 402 having opposed first and second vents 404 and 406. The body 402 further includes a first opening (not shown) and an opposed second opening 408. The openings 408 expose the impeller 300. In contrast to the casing 12, the casing 400 is not made of top and bottom pieces secured together. Rather, the casing 400 is formed by a front and rear piece 410 and 412 secured together by a plurality of fasteners 414, as shown in FIG. 22. An adapter is not shown with the casing 400, but the same adapter 84 shown in FIGS. 8-12 may be formed in the casing or attached to the casing as a separate piece. The casing 400 may be used with the impeller 10, 200, or 300.

Changes may be made in the construction, operation and arrangement of the various parts, elements, steps and procedures described herein without departing from the spirit and scope of the invention.

The invention claimed is:

1. A work machine situated in an ambient environment, comprising:

an engine compartment comprising:

a centrifugal fan comprising an impeller installed within a casing, the casing interposed between an engine and a radiator, and the casing having opposed first and second side vents;

an exhaust pipe having an exhaust opening; and a cover having opposed first and second side openings;

in which the engine, the radiator, the centrifugal fan, and the exhaust pipe are all positioned beneath the cover;

in which the exhaust opening and the first side vent are exposed to the ambient environment via the first opening formed in the cover, and the second side vent is exposed to the ambient environment via the second side opening formed in the cover.

2. A system, comprising:

the work machine of claim 1;

a first fluid contained within at least a portion of the exhaust pipe; and a second fluid contained within at least a portion of the centrifugal fan;

in which the first fluid mixes with the second fluid as the fluids are expelled from the first opening.

3. The work machine of claim 1, in which the exhaust opening is positioned directly above the first side vent.

4. The work machine of claim 1, further comprising:

an operator station;

a plurality of motive elements;

in which the engine compartment and the operator station are supported on the motive elements such that the engine compartment is situated in front of the operator station; and in which the exhaust pipe extends horizontally away from the operator station beneath the cover.

5. The work machine of claim 1, in which fluid exits the first vent in a downwards direction and exits the second vent in an upwards direction.

6. The work machine of claim 1, in which the impeller has a rotational axis and a first plate joined to a second plate by a plurality of blades; in which the first plate defines a first fluid path segment, and the plurality of blades define a second fluid path segment; and in which the first fluid path segment and the second fluid path segment are mutually exclusive.

7. The work machine of claim 6, in which a duct is formed within each of the plurality of blades; and in which the second fluid path segment is defined by at least one of the ducts.

8. The work machine of claim 6, in which the first plate defines a central opening; in which the central opening communicates with a medial zone between the plates having no peripheral wall; and in which the first fluid path segment is defined by the central opening and the medial zone.

9. The work machine of claim 6, in which fluid from around the engine enters the centrifugal fan through the second fluid path segment, and fluid from around the radiator enters the centrifugal fan through the first fluid path segment.

10. The work machine of claim 9, in which fluid flowing along the first and second fluid path segments is expelled from the centrifugal fan through the first and second side vents.

11. The work machine of claim 1, further comprising:

an operator station;

a plurality of motive elements;

in which the engine compartment and the operator station are supported on the motive elements such that the engine compartment is situated in front of the operator station;

in which the engine compartment comprises a front end and an opposed rear end, the rear end joined to the operator station; and in which the exhaust opening is positioned adjacent the front end of the engine compartment.

12. The work machine of claim 1, further comprising a first vent cover positioned over the first side vent within the first opening and a second vent cover positioned over the second side vent within the second opening.

13. The system of claim 2, in which the work machine further comprises:

an operator station;

in which the engine compartment is situated in front of the operator station when the work machine is moving along a forward path of travel; and in which the first and second fluids are expelled from the first opening such that the first and second fluids travel along a fluid path that is transverse to the forward path of travel.

14. A method, comprising:

moving a work machine comprising an engine compartment along a forward path of travel; in which the engine compartment is at least partially enclosed by a cover;

rotating a centrifugal fan interposed between an engine and a radiator within the engine compartment; in which the centrifugal fan, the engine, and the radiator are all situated beneath the cover;

expelling a first fluid from at least one side opening formed in the cover, the first fluid comprising fluid situated around an exterior of the engine or around an exterior of the radiator; and expelling a second fluid from the at least one side opening formed in the cover, the second fluid comprising exhaust fluid.

15. The method of claim 14, in which the second fluid is expelled from an opening of an exhaust pipe; and in which the exhaust pipe is situated beneath the cover.

16. The method of claim 14, in which the centrifugal fan comprises an impeller installed within a casing, the casing having at least one side vent, the method further comprising:

expelling the first fluid from the at least one side vent prior to expelling the first fluid from the at least one side opening.

17. The method of claim 14, in which the work machine further comprises an operator station, in which the engine compartment is situated in front of the operator station when moving along the forward path of travel; and in which the steps of expelling the first and second fluids from the at least one side opening comprises:

expelling the first and second fluids from the at least one opening such that the first and second fluids travel along a fluid path that is transverse to the forward path of travel.

18. The method of claim 14, in which the at least one side opening formed in the cover is characterized as a first side opening, the method further comprising:

simultaneously with expelling the first and second fluids from the first side opening, expelling the first fluid from the second side opening.

19. The method of claim 14, further comprising:

drawing the first fluid from around the radiator into the centrifugal fan through a first fluid path segment, the first fluid path segment defined by a central opening formed in the centrifugal fan; and drawing the first fluid from around the engine into the centrifugal fan through a plurality of second fluid path segments, each second fluid path segment defined by a plurality of blades.

20. The method of claim 14, further comprising:

flowing the second fluid through an exhaust pipe positioned adjacent the engine.

* * * * *